US012221677B2

(12) United States Patent
Long et al.

(10) Patent No.: US 12,221,677 B2
(45) **Date of Patent: *Feb. 11, 2025**

(54) DISPERSOIDS 7XXX ALLOY PRODUCTS WITH ENHANCED ENVIRONMENTALLY ASSISTED CRACKING AND FATIGUE CRACK GROWTH DEVIATION RESISTANCE

(71) Applicant: KAISER ALUMINUM FABRICATED PRODUCTS, LLC, Foothill Ranch, CA (US)

(72) Inventors: Zhengdong Long, Spokane, WA (US); Philippe Gomiero, Spokane Valley, WA (US); Ravi Rastogi, Liberty Lake, WA (US); Robert A. Matuska, Heath, OH (US); Garry R. McDaniel, Newark, OH (US); Jason N. Scheuring, Spokane, WA (US)

(73) Assignee: Kaiser Aluminum Fabricated Products, LLC, Foothill Ranch (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/933,633

(22) Filed: Sep. 20, 2022

(65) Prior Publication Data

US 2023/0114162 A1 Apr. 13, 2023

Related U.S. Application Data

(60) Provisional application No. 63/248,690, filed on Sep. 27, 2021.

(51) Int. Cl.

| | |
|---|---|
| ***C22C 21/10*** | (2006.01) |
| ***C21D 8/02*** | (2006.01) |
| ***C22F 1/053*** | (2006.01) |

(52) U.S. Cl.
CPC ..... *C22C 21/10* (2013.01); *C21D 8/0226* (2013.01); *C21D 8/0252* (2013.01); *C21D 8/0263* (2013.01); *C22F 1/053* (2013.01)

(58) Field of Classification Search
CPC .... C21D 8/0226; C21D 8/0252; C22C 21/10; C22F 1/053

(Continued)

(56) References Cited

U.S. PATENT DOCUMENTS

2015/0240338 A1* 8/2015 Dorward ..... C22F 1/053 148/693
2017/0088920 A1* 3/2017 Boselli ..... C22F 1/053

(Continued)

FOREIGN PATENT DOCUMENTS

| | | |
|---|---|---|
| EP | 1306455 | 5/2003 |
| WO | 2019007817 | 1/2019 |

OTHER PUBLICATIONS

Wloka, et al., "Influence of temper and surface condition on the exfoliation behaviour of high strength Al—Zn—Mg—Cu alloys", Corrosion Science, 2007, pp. 1437-1449, vol. 49.

*Primary Examiner* — Jie Yang
(74) *Attorney, Agent, or Firm* — Yancy IP Law, PLLC

(57) ABSTRACT

Dispersoids 7xxx aluminum alloy products with enhanced fatigue crack growth deviation and Environmentally Assisted Cracking (EAC) resistance are disclosed. The 7xxx aluminum alloy comprises 1 to 3 wt. % Cu, 1.2 to 3 wt. % Mg, 4 to 8.5 wt. % Zn, up to 0.3 wt. % Mn, up to 0.15 wt. % Zr, up to 0.3 wt. % Cr dispersoid elements, incidental elements, and the balance Al. In one embodiment, the alloy includes Zr+Cr+Mn in the range of 0.2 to 0.8 wt. %. In another embodiment, the alloy includes Zr+Mn in the range of 0.07 to 0.7 wt. %. This alloy can be fabricated to plate, extrusion, or forging products, and is especially suitable for aerospace structural components. The products have (Continued)

enhanced EAC resistance and fatigue crack growth deviation resistance. Meanwhile, the products have an excellent combination of strength, fracture toughness, ductility at different orientations, and Stress Crack Corrosion (SCC), and exfoliation corrosion resistance suitable for aerospace application.

16 Claims, 4 Drawing Sheets

(58) Field of Classification Search
USPC ..... 420/532
See application file for complete search history.

(56) References Cited

U.S. PATENT DOCUMENTS

| | | | | |
|---|---|---|---|---|
| 2018/0119262 | A1 | 5/2018 | Felberbaum | |
| 2018/0202031 | A1* | 7/2018 | Wu | C22F 1/002 |
| 2020/0131612 | A1* | 4/2020 | Whelchel | C22F 1/053 |
| 2022/0145439 | A1* | 5/2022 | Long | C22C 21/10 |

* cited by examiner

DISPERSOIDS 7XXX ALLOY PRODUCTS WITH ENHANCED ENVIRONMENTALLY ASSISTED CRACKING AND FATIGUE CRACK GROWTH DEVIATION RESISTANCE

CROSS-REFERENCE TO RELATED APPLICATION

This application claims the benefits, under 35 U.S.C. 119 (e), of U.S. Provisional application No. 63/248,690 filed Sep. 27, 2021, the contents of which are incorporated herein by reference.

BACKGROUND OF THE INVENTION

1. Field of the Invention

The present invention relates to high strength 7xxx aluminum alloy products. The high strength 7xxx aluminum alloy can be fabricated into plate, extrusion or forging products suitable for aerospace structural components, especially large commercial airplane wing structure applications requiring better fatigue crack branching, EAC (Environmentally Assisted Cracking) resistance, strength, fracture toughness, anisotropic ductility, Stress Crack Corrosion (SCC), and exfoliation corrosion resistance performance.

2. Description of Related Art

The higher strength 7xxx aluminum alloys are being pursued assertively by airframe manufacturers and aluminum material manufacturers in order to aggressively reduce aircraft weight for fuel efficiency due to their extensive combination of material strength, fracture toughness, and fatigue resistance.

In recent years, the new challenges of fatigue crack branching resistance, EAC resistance, and anisotropic ductility are also being significantly addressed by airframe manufacturers as well as aluminum alloy producers.

The fatigue crack deviation or branching, as shown in FIG. 1, is a phenomenon in which a crack suddenly changes its propagation path away from the expected fracture plane under Mode I fatigue loading condition. Such crack deviation is a significant concern for aircraft manufacturers since it is difficult to take into account the unpredictable nature of this phenomenon during structural design.

For aircraft industry, aluminum alloy material degrading due to Environmentally Assisted Cracking (EAC) is a key challenge. In general, EAC is an intergranular failure phenomenon for the aircraft application. Although it is not fully understood, there are two potential causes. One is anodic dissolution and the other one is hydrogen embrittlement. However, it is extremely difficult to understand the mechanisms due to the difficulty in quantifying hydrogen (H) levels accurately. The equilibrium lattice solubility of H is extremely low and the hydrides in aluminum are usually not stable.

In addition to the fatigue crack deviation and EAC, the anisotropic ductility of aluminum plate is another increasingly critical characteristic for aerospace application, especially for monolithic part machining technology recently used in airframe manufacturing. The anisotropic ductility refers to significant lowering in ductility when the tensile testing orientation is in-between the commonly tested orientations, or from the material metal flow or microstructural direction, commonly notated as rolling direction (L). The ductility is usually significantly lower when tensile direction differs from the metal flow direction.

The critical properties, including fatigue crack branching, EAC, and anisotropic ductility as well as the strength, fracture toughness, and corrosion resistance are significantly affected by chemical composition. It is also well known that zinc is the major alloying element for achieving high strength through age strengthening. Magnesium is normally added along with zinc to produce MgZn2 and its variant phases for precipitation hardening. The copper is often added in order to improve SCC resistance performance.

As known to people skilled in the art, the so-called dispersoid elements are very critical for aluminum alloys in order to control the recrystallization grain structures. The typical dispersoid elements for 7xxx alloys are Zr and Cr. The typical dispersoid element for 2xxx alloys is Mn. The effect of individual dispersoid elements on traditional material properties such as strength and fracture toughness is relatively well known. However, it is not well known whether the dispersoid element(s), whether individually or in different combinations, have a significant effect on the critical properties of fatigue crack growth branching, EAC, and anisotropic ductility. In the current related art, essentially either only Zr or only Cr is used as dispersoid element for aerospace 7xxx alloys. No high strength 7xxx alloys uses a combination of Zr, Cr and Mn as dispersoids in order to improve the critical properties of fatigue crack growth branching, EAC, and anisotropic ductility. Historically, the Cr was initially used as the dispersoid element for 7xxx alloy such as the popular 7075 alloy. However, it was believed that Cr has a negative impact on strength and fracture toughness due to the quench sensitivity. So, later generations of 7xxx alloy used Zr as dispersoid element. The most typical example is Zr containing 7050 alloy, which is the most widely used 7xxx alloy for aerospace application. Most of the 7xxx alloys use either Zr or Cr as dispersoid element. Based on "International Alloy Designations and Chemical Composition Limits for Wrought Aluminum and Wrought Aluminum Alloys" published by the Aluminum Association, it is Zr, without other dispersoid element, that is the dominant dispersoid element for 7xxx alloys, such as AA7160, AA7199, AA7003, AA7040, AA7140, AA7041, AA7056, AA7068. AA7168, AA7099, AA7065. AA7097, AA7037, AA7081, AA7047, AA7021, AA7033, AA7034, AA7035, AA7050, AA7150, AA7250, AA7055, AA7155, AA7085, AA7093, AA7095, AA7181, AA7255, AA7185, AA7010, AA7015, AA7122, AA7136, AA7046, AA7048, AA7108. The second most common dispersoid element is Cr for 7xxx alloys such as AA7075, AA7175, AA7475, AA7009, AA7049, AA7149, AA7349, AA7249, AA7008, AA7032, AA7060, AA7278, AA7178, AA7001, AA7277.

BRIEF SUMMARY OF THE INVENTION

The enhanced fatigue crack growth branching, EAC, and anisotropic ductility as well as high strength, fracture toughness, fatigue, SCC, and exfoliation 7xxx aluminum alloy products such as plates, forgings and extrusions. suitable for use in making aerospace structural components like large commercial airplane wing components, comprises 1 to 3 wt. % Cu, 1.2 to 3 wt. % Mg. 4 to 8.5 wt. % Zn, up to 0.3 wt.

% Mn, up to 0.15 wt. % Zr, up to 0.3 wt. % Cr dispersoid elements, incidental elements, and the balance Al. In one embodiment, the alloy includes Zr+Cr+Mn in the range of 0.2 to 0.8 wt. %. In another embodiment, the alloy includes Zr+Mn in the range of 0.07 to 0.7 wt. %.

It has been discovered that a 7xxx aluminum alloy using the different combinations of Zr, Cr, and Mn as dispersoid elements is capable of producing plate products with better fatigue crack branching resistance, EAC, and anisotropic ductility as well as high strength, fracture toughness, fatigue. SCC, and exfoliation resistance.

The high strength 7xxx thick plate aluminum product offers a promising opportunity for significant fuel efficiency and cost reduction advantage for commercial airplanes. An example of such an application for the present invention is the integral design wing box, which requires thick cross section 7xxx aluminum alloy products. Material strength is a key design factor for weight reduction. Also important are ductility, damage tolerance, stress corrosion resistance, and fatigue crack growth resistance.

BRIEF DESCRIPTION OF THE SEVERAL VIEWS OF THE DRAWINGS

The features and advantages of the present invention will become apparent from the following detailed description of a preferred embodiment thereof, taken in conjunction with the accompanying drawings, in which.

DETAILED DESCRIPTION OF THE INVENTION

Figure 1:
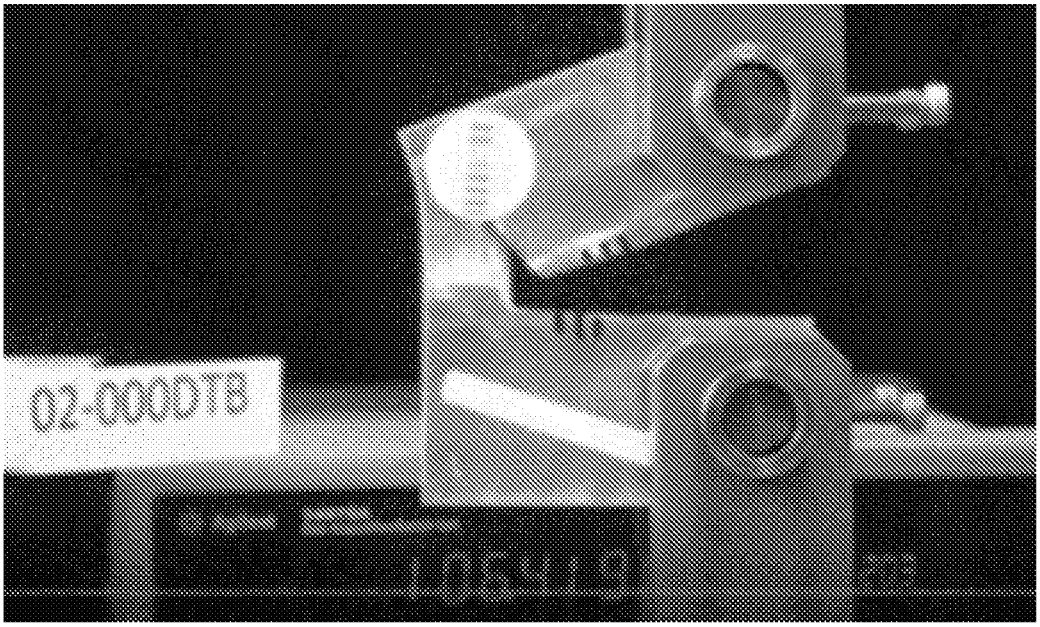
FIG. 1 is a picture showing fatigue crack deviation in a fatigue crack growth testing specimen.

An aerospace 7xxx aluminum alloy product is produced using various combinations of Zr, Cr. and Mn as dispersoid elements to achieve enhanced fatigue crack deviation resistance, EAC resistance, and anisotropic ductility as well as high strength, fracture toughness, fatigue, SCC, and exfoliation resistance. The 7xxx aluminum alloy comprises, consists essentially of, or consists of 1 to 3 wt. % Cu, 1.2 to 3 wt. % Mg. 4 to 8.5 wt. % Zn, up to 0.3 wt. % Mn, up to 0.15 wt. % Zr, up to 0.3 wt. % Cr dispersoid elements, incidental elements, and the balance Al. In one embodiment, the alloy includes Zr+Cr+Mn in the range of 0.2 to 0.8 wt. %. In another embodiment, the alloy includes Zr+Mn in the range of 0.07 to 0.7 wt. %.

The present invention includes alternate embodiments wherein the upper or lower limit for the amount of Zn in the 7xxx aluminum alloy may be selected from 4.0, 4.5, 5.0, 5.5, 6.0, 6.5, 7.0, 7.5, 8.0, and 8.5 wt. %. In addition to the alternate upper and lower limits listed above for Zn, the present invention includes alternate embodiments wherein the upper or lower limit for the amount of Cu may be selected from 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, and 3.0 wt. %. In addition to the alternate upper and lower limits listed above for Zn and Cu, the present invention includes alternate embodiments wherein the upper or lower limit for the amount of Mg may be selected from 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, and 3.0 wt. %. In addition to the alternate upper and lower limits listed above for Zn, Cu, and Mg the present invention includes alternate embodiments wherein the upper or lower limit for the amount of Zr may be selected from 0.04, 0.05, 0.06, 0.07, 0.08, 0.09, 0.10, 0.11, 0.12, 0.13, 0.14, and 0.15 wt. %. In addition to the alternate upper and lower limits listed above for Zn, Cu, Mg. and Zr, the present invention includes alternate embodiments wherein the upper or lower limit for the amount of Mn may be selected from 0, 0.05, 0.10, 0.15, 0.20, 0.25, and 0.30 wt. %. In addition to the alternate upper and lower limits listed above for Zn, Cu. Mg. Zr, and Mn, the present invention includes alternate embodiments wherein the upper or lower limit for the amount of Cr may be selected from 0, 0.05, 0.10, 0.15, 0.20, 0.25, and 0.30 wt. %. In addition to the alternate upper and lower limits listed above for Zn, Cu, Mg, Zr, Mn, and Cr, the present invention includes alternate embodiments wherein the upper or lower limit for the amount of Zr+Cr+Mn may be selected from 0.2, 0.3, 0.4, 0.5, 0.6, 0.7, and 0.8 wt. %. In addition to the alternate upper and lower limits listed above for Zn, Cu, Mg, Zr, Mn, Cr, and Zr+Mn+Cr, the present invention includes alternate embodiments wherein the upper or lower limit for the amount of Zr+Mn may be selected from 0.07, 0.1, 0.2, 0.3, 0.4, 0.5, 0.6, and 0.7 wt. %.

In one embodiment, the 7xxx aluminum alloy includes ≤0.12 wt. % Si, preferably ≤0.05 wt. % Si. In one embodiment, the 7xxx aluminum alloy includes ≤0.15 wt. % Fe, preferably ≤0.10 wt. % Fe. In one embodiment, the 7xxx aluminum alloy includes 0.005 to 0.10 wt. % Ti, preferably 0.008 to 0.08.

The "incidental elements" are not included intentionally and are present preferably up to 0.15 wt. % incidental elements, or up to 0.10 wt. % incidental elements, or up to 0.05 wt. % incidental elements, with the total of these incidental elements not exceeding 0.35 wt. %, or 0.30 wt. %, or 0.25 wt. %, or 0.20 wt. %, or 0.15 wt. %, or 0.10 wt. %. preferably <0.15 wt. % total incidental elements, or <0.10 wt. % total incidental elements, or <0.05 wt. % total incidental elements. "Incidental elements" means any other elements except the above-described Al, Cu, Mg, Zn, Mn, Zr, Cr, Si, Fe, and Ti.

The 7xxx aluminum alloy can be fabricated into plate, extrusion or forging products, preferably suitable for aerospace structural components. In one embodiment, the 7xxx aluminum alloy is a thick plate high strength aluminum alloy product having a thickness of 1 inch to 10 inch, wherein the upper or lower limits for the thickness may be 1, 2, 3, 4, 5, 6, 7, 8, 9 or 10 inches.

The ingots of the high strength 7xxx aluminum alloy product may be cast, homogenized, hot rolled, solution heat treated, cold water quenched, optionally stretched, and aged to desired temper. In one embodiment, the thick plate high strength 7xxx aluminum alloy is a plate product provided in a T7651 or T7451 temper and in the thickness range of 1 inch to 10 inch. The ingots may be homogenized at temperatures from 454 to 495° C. (849 to 923° F.). The hot rolling start temperature may be from 385 to 450° C. (725 to 842° F.). The hot rolling exit temperature may be in a similar range as the start temperature. The plates may be solution heat treated at a temperature range from 454 to 495° C. (849 to 923° F.). The plates may be cold-water quenched to room temperature and may be stretched by about 1.5 to 3%. The quenched plate may be subjected to any known aging practices known by those skilled in the art including, but not limited to, two-step aging practices that produces a final T7651 or T7451 temper. When using a T7651 or T7451 temper, the first stage temperature may be in the range of 100 to 140° C. (212 to 284° F.) for 4 to 24 hours and the second stage temperature may be in the range of 135 to 200° C. (275 to 392° F.) for 5 to 20 hours, such that the second stage is at a higher temperature than the first stage.

In a preferred embodiment, the 7xxx aluminum alloy product has an EAC survival of longer than 60 days under the testing conditions of "Temperature=70° C., relative humidity=85%, loading stress is 85% of Rp0.2 in ST direction". Additionally, in a preferred embodiment, the 7xxx aluminum alloy product has K1c L-T>100-0.85*LT-TYS, K1c T-L>54.7-0.34*LT-TYS, and K1c S-L>61.2-0.46*LT-TYS. The units of K1c and TYS are (ksi*in$^{1/2}$) and ksi respectively.

Although the following examples demonstrate various embodiments of the present invention, one skilled in the art should understand how additional high strength aluminum alloy products can be fabricated in accordance with the present invention. The examples should not be construed to limit the scope of protection provided for the present invention.

Examples (Plant Commercial Scale Trial)

Ten (10) industrial scale plates were produced by commercial DC (Direct Chill) casting followed by homogenization, hot rolling, solution heat treatment, quenching, stretching and aging processes to different thickness plates. Table 1 gives the chemical compositions of 10 commercial size plates.

The last 7 examples (313016B8, 313026B7, 313027B5, 313119B0, 313163B8, 313209B9, and 313231B3) are invention alloys with the combinations of Zr+Cr+Mn and Zr+Mn. The first three alloys (312999B6, 313001B0, and 313010B1) are non-invention alloys since they only have Zr or Cr or Mn.

TABLE 1

Chemical compositions of industrial scale invention and non-invention alloy ingots

| Invention, Yes or No | ID | Gauge, in | Dispersoid Elements | Si | Fe | Cu | Mg | Zn | Cr | Mn | Zr | Ti |
|---|---|---|---|---|---|---|---|---|---|---|---|---|
| No | 312999B6 | 3.5 | Zr | 0.042 | 0.051 | 1.715 | 2.040 | 6.665 | 0.001 | 0.000 | 0.093 | 0.022 |
| No | 313001B0 | 3.5 | Mn | 0.047 | 0.050 | 1.755 | 1.960 | 6.820 | 0.002 | 0.247 | 0.001 | 0.020 |
| No | 313010B1 | 3.5 | Cr | 0.053 | 0.063 | 1.750 | 2.010 | 6.765 | 0.152 | 0.001 | 0.001 | 0.024 |
| Yes | 313016B8 | 3.5 | Mn + Zr | 0.045 | 0.055 | 1.710 | 1.895 | 6.730 | 0.003 | 0.248 | 0.094 | 0.023 |
| Yes | 313026B7 | 3.5 | Cr + Mn + Zr | 0.045 | 0.061 | 1.725 | 1.935 | 6.700 | 0.155 | 0.252 | 0.099 | 0.022 |
| Yes | 313027B5 | 3.5 | Cr + Mn + Zr | 0.049 | 0.055 | 1.730 | 1.890 | 6.740 | 0.150 | 0.252 | 0.099 | 0.025 |
| Yes | 313119B0 | 3.5 | Cr + Mn + Zr | 0.044 | 0.056 | 1.665 | 2.085 | 7.885 | 0.146 | 0.251 | 0.098 | 0.025 |
| Yes | 313163B8 | 3.5 | Cr + Mn + Zr | 0.045 | 0.057 | 1.640 | 2.060 | 7.730 | 0.149 | 0.252 | 0.099 | 0.022 |
| Yes | 313209B9 | 2 | Cr + Mn + Zr | 0.045 | 0.061 | 1.650 | 2.080 | 7.885 | 0.147 | 0.258 | 0.100 | 0.024 |
| Yes | 313231B3 | 2 | Cr + Mn + Zr | 0.046 | 0.064 | 1.685 | 2.090 | 7.810 | 0.150 | 0.251 | 0.100 | 0.024 |

Ingots were homogenized, hot rolled, solution heat treated, quenched, stretched and aged to final temper plates in the thickness range from 1 inch to 8 inch. The ingots were homogenized at a temperature from 465 to 490° C. (869 to 914° F.). The hot rolling start temperature is from 400 to 440° C. (752 to 824° F.).

The plates were solution heat treated at temperature range from 465 to 490° C. (869 to 914° F.), cold-water quenched to room temperature and stretched at about 1.5 to 3%.

A two-step aging practice was used to produce T7651 and T7451 tempers. The first stage temperature is in the range of 110 to 130° C. (230 to 266° F.) for 4 to 12 hours and the second stage temperature is in the range of 145 to 160° C. (293 to 320° F.) for 8 to 20 hours.

Tensile strength testing was conducted based on ASTM B557 specification, the contents of which are expressly incorporated herein by reference. The plane strain fracture toughness ($K_{1c}$) was measured under ASTM E399, the contents of which are expressly incorporated herein by reference, using CT specimens.

Figure 2:
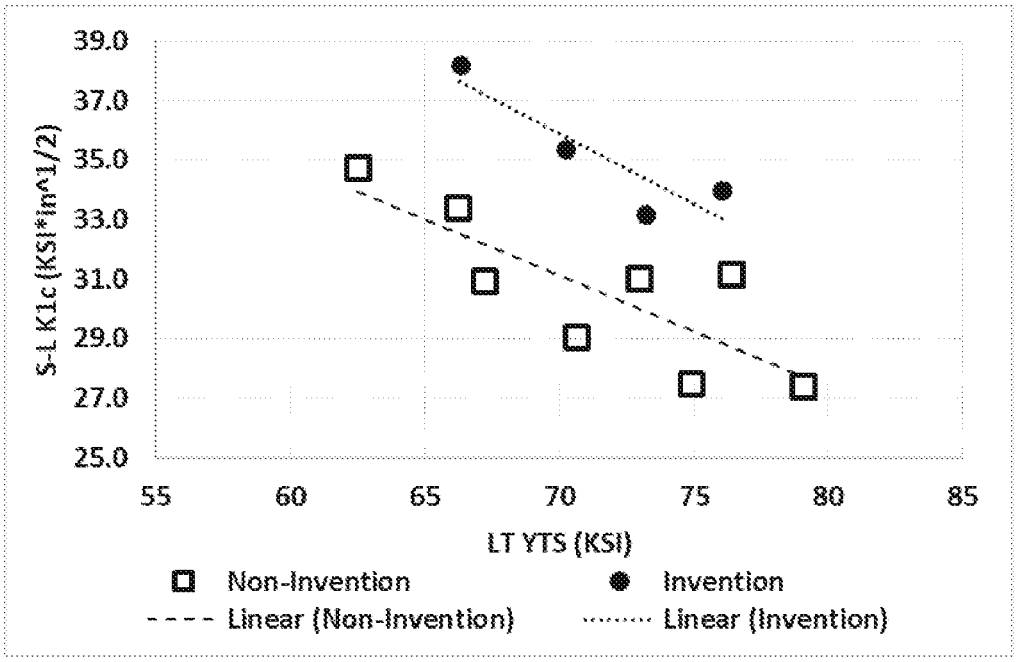
FIG. 2 is a graph showing lab age S-L fracture toughness of one invention and two non-invention alloys.
Figure 3:
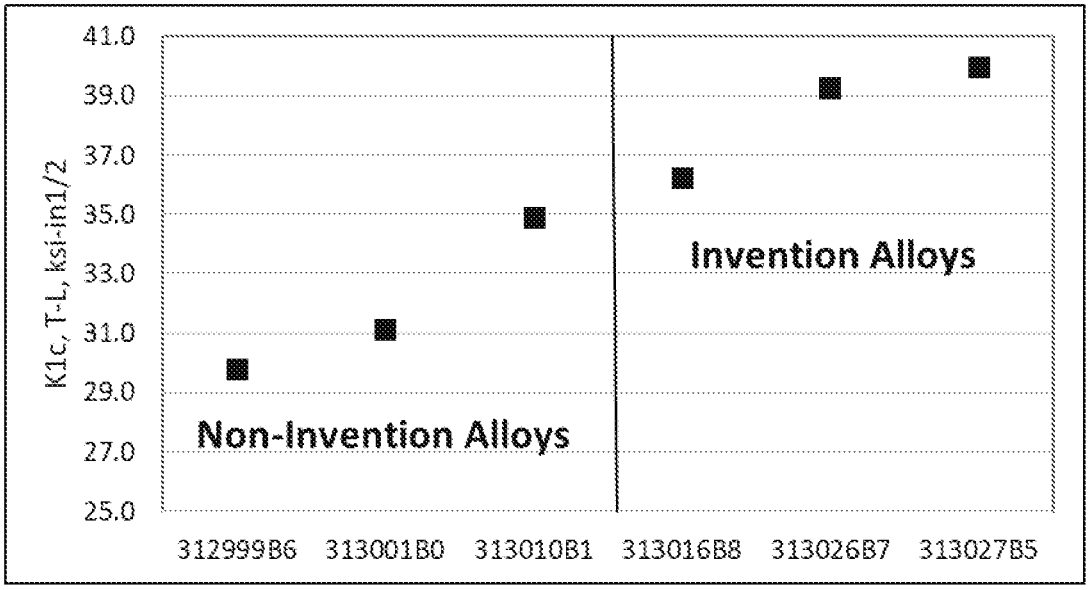
FIG. 3 is a graph showing the fracture toughness of invention and non-invention alloys with similar Zn, Cu, and Mg contents.
Figure 4:
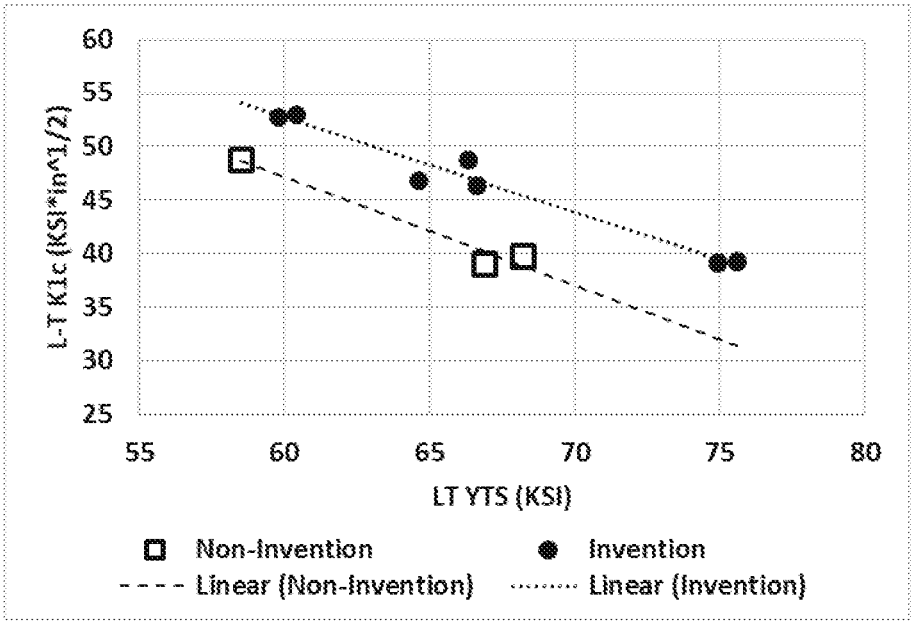
FIG. 4 is a graph showing the combination of strength in LT direction and fracture toughness in L-T orientation for invention and non-invention alloys.
Figure 5:
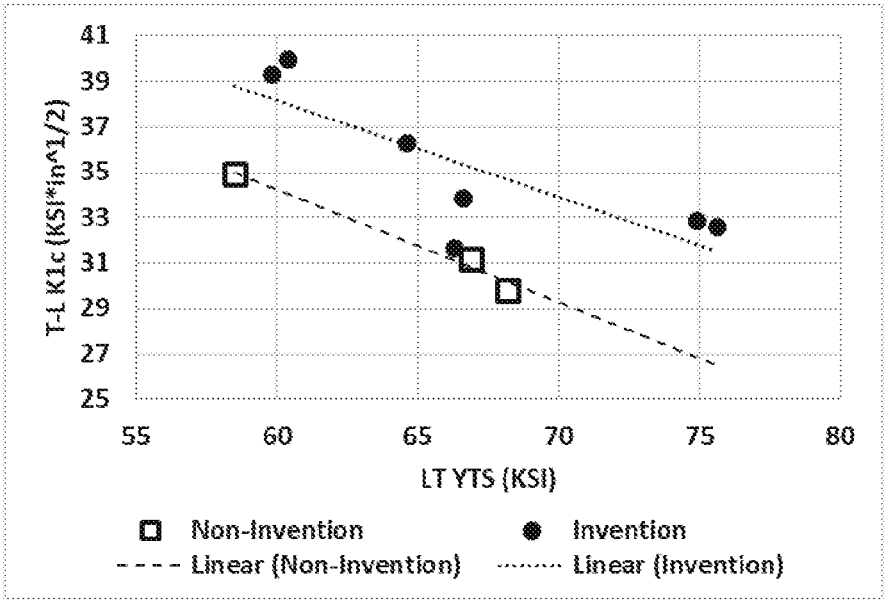
FIG. 5 is a graph showing the combination of strength in LT direction and fracture toughness in T-L orientation for invention and non-invention alloys.
Figure 6:
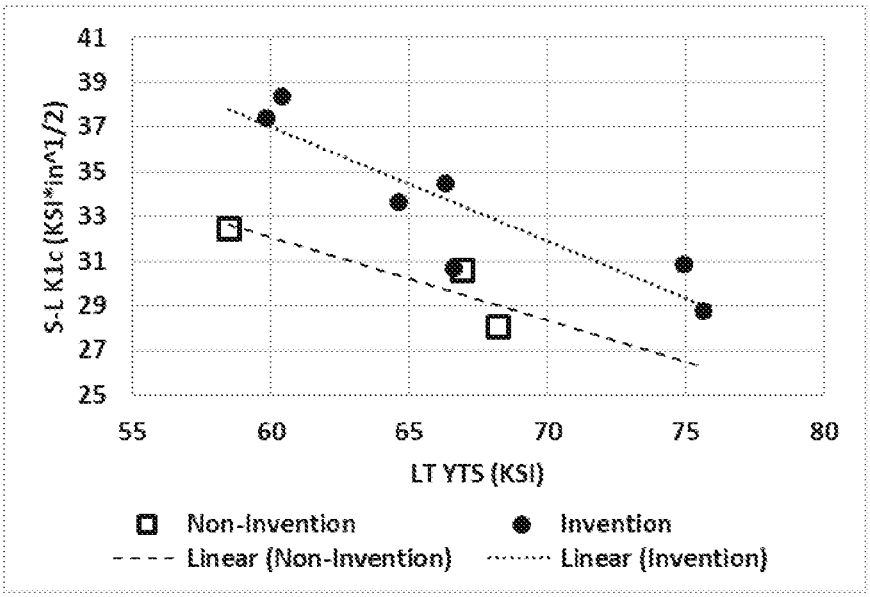
FIG. 6 is a graph showing the combination of strength in LT direction and fracture toughness in S-L orientation for invention and non-invention alloys.

The strength and fracture toughness aging response was evaluated for selected alloy variants. Table 2 shows the properties for different aging times. The results shows that the strength decrease and fracture toughness increases as aging time increases. However, the invention alloy, for a given strength level, has better fracture toughness than the non-invention alloys. This result can be even more clearly demonstrated by FIG. 2

TABLE 2

The LT-tensile strength, elongation, S-L fracture toughness and EC of one invention and two non-invention alloy plates.

| Invention Alloy, Yes or No | Lot | Alloy | Aging Time (hr) | LT YTS (ksi) | LT ELG (%) | S-L K1c (ksi * in^1/2) | EC (% IACS) |
|---|---|---|---|---|---|---|---|
| N | 312999B6 | Zr | 3.0 | 79.1 | 10.6 | 27.4 | 39.2 |
| N | 312999B6 | Zr | 3.9 | 74.9 | 9.3 | 27.5 | 39.3 |
| N | 312999B6 | Zr | 7.8 | 70.7 | 11.3 | 29.1 | 41.4 |
| N | 312999B6 | Zr | 11.2 | 67.2 | 12.0 | 31.0 | 42.2 |
| N | 313010B1 | Cr | 3.0 | 76.4 | 11.6 | 31.2 | 39.9 |
| N | 313010B1 | Cr | 3.9 | 73.0 | 10.5 | 31.1 | 39.4 |
| N | 313010B1 | Cr | 7.8 | 66.2 | 10.9 | 33.4 | 41.5 |
| N | 313010B1 | Cr | 11.2 | 62.5 | 11.0 | 34.8 | 42.5 |
| Y | 313026B7 | Zr + Cr + Mn | 3.0 | 76.1 | 10.6 | 34.0 | 36.3 |
| Y | 313026B7 | Zr + Cr + Mn | 3.9 | 73.2 | 11.0 | 33.2 | 36.8 |
| Y | 313026B7 | Zr + Cr + Mn | 7.8 | 70.3 | 10.4 | 35.4 | 36.8 |
| Y | 313026B7 | Zr + Cr + Mn | 11.2 | 66.3 | 11.4 | 38.2 | 37.8 |

The comprehensive characterization of strength, fracture toughness, corrosion resistance, fatigue crack deviation resistance, and anisotropic ductility that are critical for aerospace applications were conducted for selected aging temperature and time.

Table 3 gives the tensile properties and fracture toughness for invention and non-invention alloy samples. The common terminologies familiar to those skilled in the art are used in this table for strength and fracture toughness.

The invention alloy has better fracture toughness. This can be seen in Table 3 and also exemplarily demonstrated by FIG. 3, which compare the fracture toughness of invention and non-invention alloys with similar Zn, Cu, and Mg contents. As shown in FIGS. 3, 4, 5 and 6, the invention alloy has better performance in terms of the combination of strength and fracture toughness than non-invention alloy.

TABLE 3

The strength, elongation, and fracture toughness of invention and non-invention alloy plates

| Invention Alloy, Yes or No | ID | Gauge, in | Dispersoid Elements | LT UTS (ksi) | LT YTS (ksi) | LT ELG (%) | L UTS (ksi) | L YTS (ksi) | L ELG (%) | ST UTS (ksi) | ST YTS (ksi) | ST ELG (%) | L-T K1c (ksi * in^1/2) | T-L K1c (ksi * in^1/2) | S-L K1c (ksi * in^1/2) |
|---|---|---|---|---|---|---|---|---|---|---|---|---|---|---|---|
| No | 312999B6 | 3.5 | Zr | 75.5 | 67.4 | 11.9 | 75.0 | 68.2 | 14.9 | 74.1 | 63.6 | 8.1 | 39.8 | 29.8 | 28.1 |
| No | 313001B0 | 3.5 | Mn | 74.3 | 65.4 | 9.7 | 73.9 | 66.9 | 11.4 | 71.9 | 62.1 | 7.2 | 39.1 | 31.2 | 30.6 |
| No | 313010B1 | 3.5 | Cr | 68.4 | 57.9 | 12.6 | 68.5 | 58.5 | 15.9 | 68.4 | 56.2 | 7.9 | 48.8 | 34.9 | 32.5 |
| Yes | 313016B8 | 3.5 | Mn + Zr | 73.1 | 63.4 | 11.7 | 72.5 | 64.6 | 14.5 | 72.0 | 60.3 | 7.6 | 46.9 | 36.3 | 33.7 |
| Yes | 313026B7 | 3.5 | Cr + Mn + Zr | 70.0 | 58.8 | 12.2 | 70.0 | 59.8 | 14.7 | 70.6 | 58.0 | 9.4 | 52.8 | 39.3 | 37.4 |
| Yes | 313027B5 | 3.5 | Cr + Mn + Zr | 69.8 | 59.1 | 12.7 | 70.2 | 60.4 | 15.3 | 70.4 | 58.1 | 9.1 | 53.1 | 40.0 | 38.4 |
| Yes | 313119B0 | 3.5 | Cr + Mn + Zr | 74.9 | 64.8 | 11.0 | 74.8 | 66.3 | 14.6 | 76.4 | 63.7 | 7.7 | 48.8 | 31.7 | 34.5 |
| Yes | 313163B8 | 3.5 | Cr + Mn + Zr | 75.0 | 64.8 | 11.2 | 75.0 | 66.6 | 13.9 | 76.6 | 64.1 | 9.3 | 46.4 | 33.9 | 30.7 |
| Yes | 313209B9 | 2 | Cr + Mn + Zr | 82.9 | 75.7 | 12.7 | 80.9 | 75.6 | 13.2 | 81.1 | 70.9 | 5.7 | 39.3 | 32.6 | 28.8 |
| Yes | 313231B3 | 2 | Cr + Mn + Zr | 82.4 | 74.9 | 12.8 | 80.6 | 74.9 | 13.8 | 82.1 | 70.7 | 7.0 | 39.2 | 32.9 | 30.9 |

Environmentally Assisted Cracking (EAC) resistance is a critical product property requirement for aerospace application. One common evaluation method is to test the duration days before failure under certain load and test conditions of Temperature=70° C., relative humidity=85%. In the current patent application, the loading stress is at 85% of Rp0.2 in ST direction. The sample is taken at ST direction centered at T/2 (middle of the plate thickness).

The EAC is of greater concern for recent high strength 7xxx aluminum alloys. Most of the recently developed high strength 7xxx aerospace alloys use Zr as dispersoid element, without Cr and Mn dispersoid elements.

Table 4 gives the chemistries of the recently developed high strength 7xxx aluminum alloy. The Zr is in the range of 0.07 to 0.12 wt. %. The Cr and Mn only exist in these alloys as impurity elements. The levels are extremely low, at equal to or less than 0.01 wt. %. As commercial scale experimental examples, the plates of such alloys were fabricated under normal industrial scale practice known by anyone with ordinary skill in the art.

TABLE 4

The chemistries of the recently developed high strength 7xxx alloy with Zr dispersoid element

| Invention Alloy, Yes or No | Dispersoid Elements | Plate ID | Gauge, in | Cu | Mg | Zn | Cr | Zr | Mn | Ti | Si | Fe |
|---|---|---|---|---|---|---|---|---|---|---|---|---|
| No | Zr | A7085 | 4.50 | 1.63 | 1.53 | 7.32 | 0.00 | 0.12 | 0.00 | 0.02 | 0.03 | 0.03 |
| No | Zr | C7449 | 4.00 | 1.91 | 2.10 | 7.82 | 0.01 | 0.10 | 0.01 | 0.02 | 0.04 | 0.07 |
| No | Zr | C7056 | 3.00 | 1.70 | 1.70 | 8.65 | 0.01 | 0.07 | 0.01 | 0.03 | 0.04 | 0.07 |
| No | Zr | T0097 | 4.00 | 1.36 | 1.85 | 8.19 | 0.00 | 0.11 | 0.00 | 0.02 | 0.03 | 0.07 |
| No | Zr | T0099 | 3.00 | 1.74 | 2.05 | 7.73 | 0.00 | 0.09 | 0,00 | 0.04 | 0.03 | 0.05 |

The following Table 5 gives the EAC testing results. Three testing coupons (Rep1, Rep2, Rep3) were tested for invention alloy plates (313016B8 and 313026B7) and non-invention alloy plates (A7085, C7449, C7056, T0097, T0099). The results indicate that the present invention alloy has much better EAC resistance than other non-invention high strength alloys. For Cr+Mn+Zr invention alloy plate ID 313026B7, the three coupons survived even after 150 days, which is the cutoff days for EAC testing. In contrast, all non-invention alloy coupons failed EAC testing in the range from 3 to 21 days.

TABLE 5

EAC testing performance of alloys, at 70° C. and 85% RH.

| Invention Alloy, Yes or No | Dispersoid Elements | Plate ID | Gauge, in | Loading Stress % of ST TYS | EAC Days of Failures Rep1 | Rep2 | Rep3 |
|---|---|---|---|---|---|---|---|
| Yes | Mn + Zr | 313016B8 | 3.50 | 85% | 69 | 67 | 62 |
| Yes | Cr + Mn + Zr | 313026B7 | 3.50 | 85% | >150 | >150 | >150 |
| No | Zr | A7085 | 4.50 | 85% | 15 | 20 | 14 |
| No | Zr | C7449 | 4.00 | 85% | 12 | 12 | 12 |
| No | Zr | C7056 | 3.00 | 85% | 3 | 1 | 1 |
| No | Zr | T0097 | 4.00 | 85% | 3 | 3 | 3 |
| No | Zr | T0099 | 3.00 | 85% | 17 | 18 | 21 |

The fatigue crack deviation was evaluated based on ASTM E647, the contents of which are expressly incorporated herein by reference. The coupon orientation is L-S, which has the highest chance to have crack deviation during crack propagation. The standard Compact Tension, i.e. C (T), coupon dimension was used for this test. The FCGR testing procedure was according to ASTM E647 in general with the following specific requirements: (1) R=0.1 and f=25 Hz; (2) Pre-cracking was conducted under constant load amplitude. After pre-cracking, the testing is conducted under constant load amplitude at the same load as pre-cracking. The test was conducted at room temperature (e.g. 66-85° F.). The relative humidity (RH) is under normal lab environment.

The determination of crack deviation was based on "anything that would normally invalidate the E647 FCG test (up to the point of crack deviation)" would invalidate the $K_{max\text{-}dev}$ test (e.g. crack growth out of plane by more than 20° or crack deviation after the remaining ligament criterion is exceeded). After the deviation branching point was determined, the crack length was measured and calculated by three point weighted average method based on fracture sample. The equation for weighted average length is a=(front+back+2*center)/4. The longer crack length and higher $K_{max\text{-}dev}$ indicate better crack deviation resistance.

Figure 7:
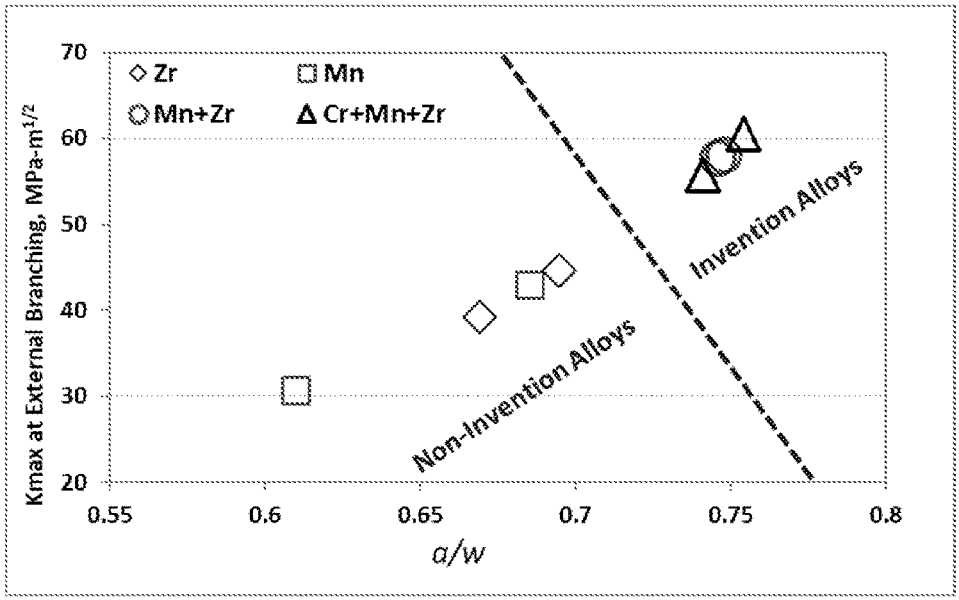
FIG. 7 is a graph showing the $K_{max\text{-}dev}$ and normalized crack length (a/w) of invention and non-invention alloys.

The crack length and $K_{max\text{-}dev}$ at the crack deviation point are given in Table 6 for invention non-invention alloy lots. The "Crack Length/W" is the normalized crack length per testing coupon width. FIG. 7 gives the comparison of the combination of normalized crack length and $K_{max\text{-}dev}$ for invention and non-invention alloys plates in the thickness range of 3.5 inches. It can be seen that invention alloy plates have much better crack growth deviation resistance in terms of both crack length and $K_{max\text{-}dev}$ at the crack deviation point.

TABLE 6

The $K_{max\text{-}dev}$ and crack length at the crack deviation point for invention and non-invention alloys

| Invention Alloy, Yes or No | Plate Ga, in | ID | Dispersoid Elements | Test Repeat | Orientation | Crack length, mm | Crack Length/W | $K_{max\text{-}dev}$ MPa * $m^{1/2}$ |
|---|---|---|---|---|---|---|---|---|
| No | 3.5 | 312999B6 | Zr | 1 | L-S | 44.11 | 0.69 | 44.60 |
| | | | | 2 | L-S | 42.49 | 0.67 | 39.15 |

TABLE 6-continued

The $K_{max\text{-}dev}$ and crack length at the crack deviation point for invention and non-invention alloys

| Invention Alloy, Yes or No | Plate Ga, in | ID | Dispersoid Elements | Test Repeat | Orientation | Crack length, mm | Crack Length/W | $K_{max\text{-}dev}$ MPa * $m^{1/2}$ |
|---|---|---|---|---|---|---|---|---|
| No | 3.5 | 313001B0 | Mn | 1 | L-S | 43.55 | 0.69 | 42.75 |
| | | | | 2 | L-S | 38.76 | 0.61 | 30.49 |
| Yes | 3.5 | 313016B8 | Mn + Zr | 1 | L-S | 47.38 | 0.75 | 57.66 |
| | | | | 2 | L-S | 47.50 | 0.75 | 57.95 |
| Yes | 3.5 | 313026B7 | Cr + | 1 | L-S | 47.05 | 0.74 | 55.73 |
| | | | Mn + Zr | 2 | L-S | 47.88 | 0.75 | 60.53 |

The anisotropic tensile properties, especially anisotropic tensile ductility, can be significantly different for different testing directions. Such anisotropic material behavior is very important for high strength thick plate aerospace applications. People skilled in the art normally use the 45 degrees off thickness (ST) direction toward L direction (ST45L) as orthotropic testing direction since it is the worst ductility orientation. The coupon was cut from T/2 location. The testing results are given in Table 7. As demonstrated in Table 7, the invention alloy has better combination of strength and anisotropic ductility.

TABLE 7

Anisotropic ductility of for invention and non-invention alloys

| Invention Alloy, Yes or No | ID | Gauge, in | Base Alloy Chemistry | Dispersoid Elements | LT YTS (ksi) | Elongation, % ST-45-L |
|---|---|---|---|---|---|---|
| No | 312999B6 | 3.5 | NG7x | Zr | 67.4 | 3.35 |
| No | 313001B0 | 3.5 | NG7x | Mn | 65.4 | 2.90 |
| No | 313010B1 | 3.5 | NG7x | Cr | 57.9 | 5.60 |
| Yes | 313016B8 | 3.5 | NG7x | Mn + Zr | 63.4 | 3.70 |
| Yes | 313026B7 | 3.5 | NG7x | Cr + Mn + Zr | 58.8 | 4.65 |
| Yes | 313027B5 | 3.5 | NG7x | Cr + Mn + Zr | 59.1 | 5.90 |
| Yes | 313119B0 | 3.5 | 7099 | Cr + Mn + Zr | 64.8 | 3.65 |
| Yes | 313163B8 | 3.5 | 7099 | Cr + Mn + Zr | 64.8 | 2.70 |

Stress corrosion resistance is critical for aerospace application. The standard stress corrosion cracking resistance testing was performed in accordance with the requirements of ASTM G47, the contents of which are expressly incorporated herein by reference, which is alternate immersion in a 3.5% NaCl solution under constant deflection. Three specimens (Repeat 1, Repeat 2, and Repeat 3) were tested per sample. The testing stress levels are 25 ksi, 35 ksi, and 45 ksi, which are the stress thresholds for T7651, T7451 and T7351 respectively. The threshold testing duration days without failure is normally 20 days. The testing direction is ST direction. The testing coupons were extracted from plate center.

Table 8 gives the SCC testing results. All invention and non-invention alloy specimens survived 20 days testing at 25 ksi. Therefore, all of the samples meet T7651 temper requirements. For 3.5" plate, all specimens survived 20 days testing at 35 ksi and 45 ksi. Therefore, all of the 3.5" plates also meet T7451 and T7351 temper requirements.

TABLE 8

The SCC testing results

| Invention | | | | SCC at 25 ksi | | | SCC at 35 ksi | | | SCC at 45 ksi | | |
|---|---|---|---|---|---|---|---|---|---|---|---|---|
| Alloy, Yes or No | ID | Gauge, in | Dispersoid Elements | Repeat 1 | Repeat 2 | Repeat 3 | Repeat 1 | Repeat 2 | Repeat 3 | Repeat 1 | Repeat 2 | Repeat 3 |
| No | 312999B6 | 3.5 | Zr | >49 | >49 | >49 | 36 | 38 | >49 | 24 | 35 | >49 |
| No | 313001B0 | 3.5 | Mn | >49 | >49 | >49 | >49 | >49 | >49 | 28 | >49 | >49 |
| No | 313010B1 | 3.5 | Cr | >49 | >49 | >49 | >49 | >49 | >49 | >49 | >49 | >49 |
| Yes | 313016B8 | 3.5 | Mn + Zr | >49 | >49 | >49 | >49 | >49 | >49 | >49 | >49 | >49 |
| Yes | 313026B7 | 3.5 | Cr + Mn + Zr | >49 | >49 | >49 | >49 | >49 | >49 | >49 | >49 | >49 |
| Yes | 313027B5 | 3.5 | Cr + Mn + Zr | >49 | >49 | >49 | >49 | >49 | >49 | >49 | >49 | >49 |
| Yes | 313119B0 | 3.5 | Cr + Mn + Zr | >49 | >49 | >49 | 38 | 48 | >49 | 21 | 29 | >49 |

TABLE 8-continued

The SCC testing results

| Invention Alloy, Yes or No | ID | Gauge, in | Dispersoid Elements | SCC at 25 ksi Repeat 1 | SCC at 25 ksi Repeat 2 | SCC at 25 ksi Repeat 3 | SCC at 35 ksi Repeat 1 | SCC at 35 ksi Repeat 2 | SCC at 35 ksi Repeat 3 | SCC at 45 ksi Repeat 1 | SCC at 45 ksi Repeat 2 | SCC at 45 ksi Repeat 3 |
|---|---|---|---|---|---|---|---|---|---|---|---|---|
| Yes | 313163B8 | 3.5 | Cr + Mn + Zr | 48 | >49 | >49 | 48 | >49 | >49 | 27 | 38 | 44 |
| Yes | 313209B9 | 2 | Cr + Mn + Zr | 35 | 35 | 37 | 5 | 5 | 12 | 5 | 5 | 5 |
| Yes | 313231B3 | 2 | Cr + Mn + Zr | 33 | >49 | >49 | 12 | 13 | 34 | 5 | 7 | 8 |

The exfoliation corrosion resistance was tested according to ASTM G34, the contents of which are expressly incorporated herein by reference. The specimen size is 51 mm (2") in the LT direction and 102 mm (4") in the L direction. Testing was performed at thickness positions of surface (T/10) and plate center (T/2). As shown in Table 9, all samples were rated as pitting, which is passing based on ASTM G34.

TABLE 9

Exfoliation corrosion resistance testing result of invention alloys

| Invention Alloy, Yes or No | ID | Gauge, in | Dispersoid Elements | EXCO Rating T/2 | EXCO Rating T/10 | EXCO Result |
|---|---|---|---|---|---|---|
| No | 312999B6 | 3.5 | Zr | Pitting | Pitting | Pass |
| No | 313001B0 | 3.5 | Mn | Pitting | Pitting | Pass |
| No | 313010B1 | 3.5 | Cr | Pitting | Pitting | Pass |
| Yes | 313016B8 | 3.5 | Mn + Zr | Pitting | Pitting | Pass |
| Yes | 313026B7 | 3.5 | Cr + Mn + Zr | Pitting | Pitting | Pass |
| Yes | 313027B5 | 3.5 | Cr + Mn + Zr | Pitting | Pitting | Pass |
| Yes | 313119B0 | 3.5 | Cr + Mn + Zr | Pitting | Pitting | Pass |
| Yes | 313163B8 | 3.5 | Cr + Mn + Zr | Pitting | Pitting | Pass |
| Yes | 313209B9 | 2 | Cr + Mn + Zr | Pitting | Pitting | Pass |
| Yes | 313231B3 | 2 | Cr + Mn + Zr | Pitting | Pitting | Pass |

Smooth fatigue property was tested in accordance with the requirements of ASTM E466, the contents of which are expressly incorporated herein by reference. LT specimens were tested from each plate at plate mid-thickness, and centered along transverse direction. Table 10 gives the fatigue testing result. All plates met the common industrially accepted criterion, i.e. 90,000 cycles of individual specimen and 120,000 cycles of logarithm average of all specimens.

TABLE 10

Smooth fatigue testing result of invention alloys

| Invention Alloy, Yes or No | ID | Gauge, in | Dispersoid Elements | Fatigue at Head, cycles | Fatigue at Tail, cycles |
|---|---|---|---|---|---|
| No | 312999B6 | 3.5 | Zr | 200000 | 200000 |
| No | 313001B0 | 3.5 | Mn | 200000 | 200000 |
| No | 313010B1 | 3.5 | Cr | 200000 | 200000 |
| Yes | 313016B8 | 3.5 | Mn + Zr | 200000 | 200001 |
| Yes | 313026B7 | 3.5 | Cr + Mn + Zr | 200001 | 200000 |
| Yes | 313027B5 | 3.5 | Cr + Mn + Zr | 114830 | 200000 |
| Yes | 313119B0 | 3.5 | Cr + Mn + Zr | 300000 | 300000 |
| Yes | 313163B8 | 3.5 | Cr + Mn + Zr | 300000 | 300000 |
| Yes | 313209B9 | 2 | Cr + Mn + Zr | 300000 | 300000 |
| Yes | 313231B3 | 2 | Cr + Mn + Zr | 300000 | 300000 |

Figure 8:
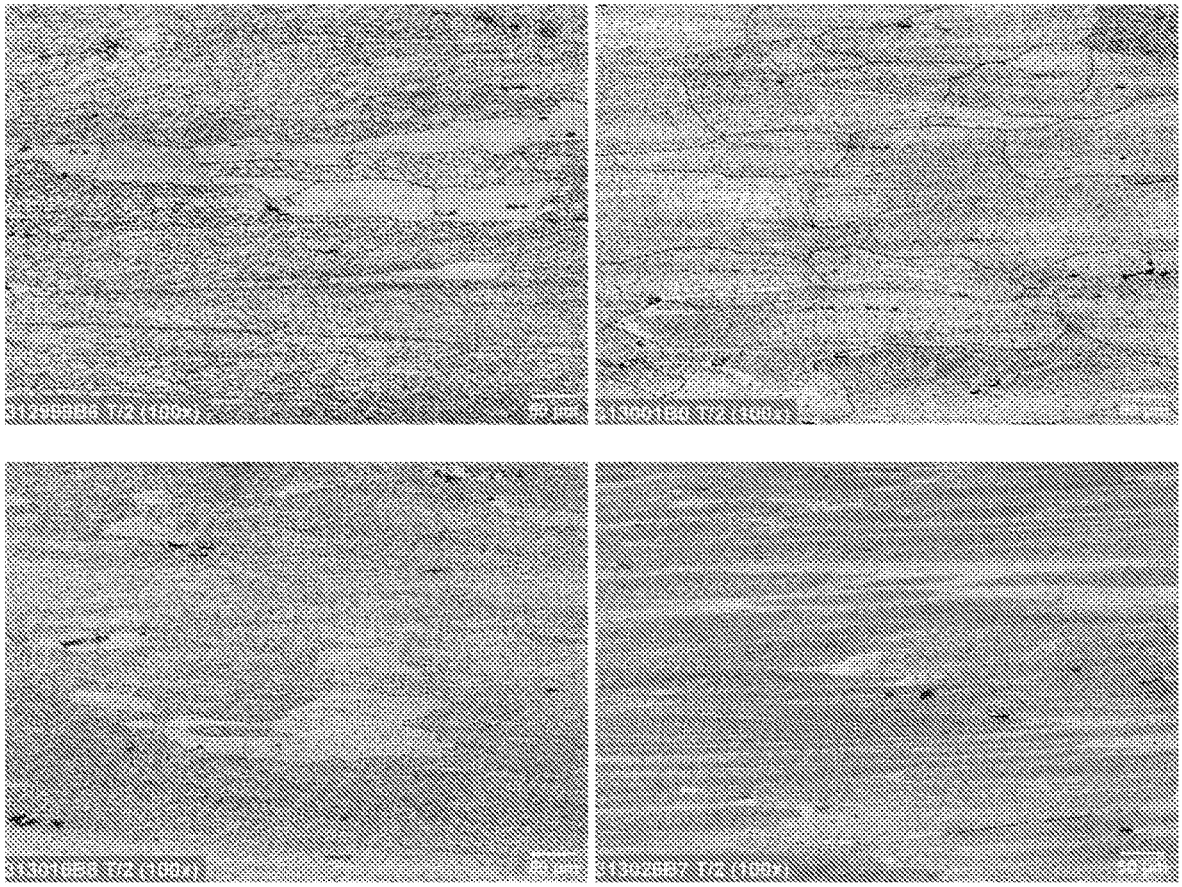
FIG. 8 are images of the microstructure of invention and non-invention alloys

The grain structure, especially recrystallization grain structure, is strongly affected by dispersoid elements. FIG. 8 gives the typical grain structures of non-invention Zr only alloy (312999B6), non-invention Mn only (313001B0) alloy as well as invention Mn+Cr (313016B8) alloy and invention Cr+Mn+Zr (313026B7) alloy. Table 11 gives the volume percentage of recrystallized grains at different through thickness layers of T/8, T/4, and T/2. The recrystallization was surprisingly reduced for invention Mn+Zr and Cr+Mn+Zr alloys.

TABLE 11

The recrystallization of invention and non-invention alloys at different through thickness layers of T/8, T/4, and T/2

| Invention Alloy, Yes or No | ID | Gauge, in | Dispersoid Elements | Recrystallization, % T/8 | T/4 | T/2 | Average |
|---|---|---|---|---|---|---|---|
| No | 312999B6 | 3.5 | Zr | 1.1 | 5.0 | 8.3 | 4.8 |
| No | 313001B0 | 3.5 | Mn | 100 | 100 | 100 | 100 |
| Yes | 313016B8 | 3.5 | Mn + Zr | 0.2 | 4.0 | 4.3 | 2.8 |
| Yes | 313026B7 | 3.5 | Cr + Mn + Zr | 0.0 | 0.3 | 0.5 | 0.3 |
| Yes | 313027B5 | 3.5 | Cr + Mn + Zr | 0.0 | 0.1 | 0.5 | 0.2 |
| Yes | 313119B0 | 3.5 | Cr + Mn + Zr | 0.0 | 0.1 | 0.2 | 0.1 |
| Yes | 313163B8 | 3.5 | Cr + Mn + Zr | 0.1 | 0.1 | 0.5 | 0.2 |
| Yes | 313209B9 | 2 | Cr + Mn + Zr | 0.0 | 0.1 | 0.2 | 0.1 |
| Yes | 313231B3 | 2 | Cr + Mn + Zr | 0.0 | 0.2 | 0.6 | 0.3 |

Although the present invention has been disclosed in terms of a preferred embodiment, it will be understood that numerous additional modifications and variations could be made thereto without departing from the scope of the invention as defined by the following claims:

We claim:

1. A 7xxx aluminum alloy product comprising,
4.0 to 8.5 wt. % Zn,
1.0 to 3.0 wt. % Cu,
1.8 to 3.0 wt. % Mg,
0.08 to 0.15 wt. % Zr as dispersoid element,
0.20 to 0.30 wt. % Mn as dispersoid element,
up to 0.30 wt. % Cr as dispersoid element,
not exceeding a total of 0.35 wt. % incidental elements, and the balance Al, wherein Zr+Cr+Mn ranges from 0.2 to 0.8 wt. % and Zr+Mn ranges from 0.3 to 0.7 wt. %, and
wherein said aluminum alloy product has an Environmentally Assisted Cracking (EAC) survival longer than 60 days under the testing conditions of temperature=70° C., relative humidity=85%, loading stress is 85% of Rp0.2 in ST direction.

2. The aluminum alloy product of claim 1 further comprising ≤0.12 wt. % Si.

3. The aluminum alloy product of claim 2 comprising ≤0.05 wt. % Si.

4. The aluminum alloy product of claim 1 further comprising ≤0.15 wt. % Fe.

5. The aluminum alloy product of claim 4 comprising ≤0.10 wt. % Fe.

6. The aluminum alloy product of claim 1 further comprising 0.005-0.10 wt. % Ti.

7. The aluminum alloy product of claim 1 having K1c L-T>100-0.85*LT-TYS, K1c T-L>54.7-0.34*LT-TYS, and K1c S-L>61.2-0.46*LT-TYS, wherein the units of K1c and TYS are (ksi*in$^{1/2}$) and ksi respectively.

8. The aluminum alloy product of claim 1 wherein said aluminum alloy product is a 1-10 inches thick plate, extrusion, or forging product.

9. The aluminum alloy product of claim 1 comprising up to 0.15 wt. % of an incident element.

10. The aluminum alloy product of claim 1 comprising 1.895 to 2.090 wt. % Mg.

11. A 7xxx aluminum alloy product consisting of, 4.0 to 8.5 wt. % Zn, 1.0 to 3.0 wt. % Cu, 1.8 to 3.0 wt. % Mg, 0.08 to 0.15 wt. % Zr as dispersoid element, 0.20 to 0.30 wt. % Mn as dispersoid element, up to 0.30 wt. % Cr as dispersoid element, ≤0.12 wt. % Si, ≤0.15 wt. % Fe, 0.005-0.10 wt. % Ti, not exceeding a total of 0.35 wt. % incidental elements, and the balance Al, wherein Zr+Cr+Mn ranges from 0.2 to 0.8 wt. % and Zr+Mn ranges from 0.3 to 0.7 wt. %, and wherein said aluminum alloy product has an Environmentally Assisted Cracking (EAC) survival longer than 60 days under the testing conditions of temperature=70° C., relative humidity=85%, loading stress is 85% of Rp0.2 in ST direction.

12. The aluminum alloy product of claim 11 comprising ≤0.05 wt. % Si.

13. The aluminum alloy product of claim 11 comprising ≤0.10 wt. % Fe.

14. The aluminum alloy product of claim 11 having K1c L-T>100-0.85*LT-TYS, K1c T-L>54.7-0.34*LT-TYS, and K1c S-L>61.2-0.46*LT-TYS, wherein the units of K1c and TYS are (ksi*in$^{1/2}$) and ksi respectively.

15. The aluminum alloy product of claim 11 wherein said aluminum alloy product is a 1-10 inches thick plate, extrusion, or forging product.

16. The aluminum alloy product of claim 11 comprising up to 0.15 wt. % of an incident element.

* * * * *